US012698143B2

(12) United States Patent
Hoshi et al.

(10) Patent No.: US 12,698,143 B2
(45) Date of Patent: Aug. 4, 2026

(54) PACKAGED NEGATIVE ELECTRODE MATERIAL, METHOD FOR TRANSPORTING NEGATIVE ELECTRODE MATERIAL, CONTAINER FOR STORING NEGATIVE ELECTRODE MATERIAL, METHOD FOR STORING NEGATIVE ELECTRODE MATERIAL, AND METHOD FOR MANUFACTURING NEGATIVE ELECTRODE

(71) Applicant: RESONAC CORPORATION, Tokyo (JP)

(72) Inventors: Kento Hoshi, Tokyo (JP); Motohiro Isaka, Tokyo (JP)

(73) Assignee: RESONAC CORPORATION, Tokyo (JP)

( * ) Notice: Subject to any disclaimer, the term of this patent is extended or adjusted under 35 U.S.C. 154(b) by 578 days.

(21) Appl. No.: 18/256,032

(22) PCT Filed: Dec. 9, 2021

(86) PCT No.: PCT/JP2021/045418
§ 371 (c)(1),
(2) Date: Dec. 21, 2023

(87) PCT Pub. No.: WO2022/124382
PCT Pub. Date: Jun. 16, 2022

(65) Prior Publication Data

US 2024/0132269 A1 Apr. 25, 2024

(30) Foreign Application Priority Data

Dec. 9, 2020 (WO) ..... PCT/JP2020/045907

(51) Int. Cl.
*B65D 81/24* (2006.01)
*H01M 4/04* (2006.01)

(52) U.S. Cl.
CPC ..... *B65D 81/24* (2013.01)

(58) Field of Classification Search
CPC ..... B65D 81/24; H01M 4/02; H01M 4/0404; Y02E 60/10
USPC ..... 206/701; 429/163, 176, 177
See application file for complete search history.

(56) References Cited

U.S. PATENT DOCUMENTS

| | | | | |
|---|---|---|---|---|
| 12,358,683 | B2 * | 7/2025 | Yerly | B65D 65/42 |
| 2009/0013760 | A1 * | 1/2009 | Chiba | B32B 27/32 73/29.04 |
| 2017/0200923 | A1 * | 7/2017 | Weinstein | H01M 50/124 |
| 2018/0166665 | A1 * | 6/2018 | Audebert | G02C 7/04 |

(Continued)

FOREIGN PATENT DOCUMENTS

| | | | |
|---|---|---|---|
| JP | 2001-278353 | A | 10/2001 |
| JP | 2008-050237 | A | 3/2008 |

(Continued)

*Primary Examiner* — Luan K Bui
(74) *Attorney, Agent, or Firm* — SOLARIS Intellectual Property Group, PLLC

(57) ABSTRACT

A packaged negative electrode material, comprising a container and a negative electrode material contained in the container, the container having a water vapor transmission rate of 150 g/(m$^2$·d)(40° C./90% RH) or less, and the negative electrode material having a micropore volume of $0.40\times10^{-3}$ m$^3$/kg or less.

11 Claims, 1 Drawing Sheet

(56) References Cited

U.S. PATENT DOCUMENTS

| | | | | |
|---|---|---|---|---|
| 2019/0055070 | A1* | 2/2019 | Brown | B65D 53/08 |
| 2019/0348679 | A1 | 11/2019 | Hoshi et al. | |
| 2019/0367247 | A1* | 12/2019 | Romeo | B65D 81/266 |
| 2021/0091385 | A1 | 3/2021 | Furutani et al. | |
| 2023/0123531 | A1* | 4/2023 | Vishtal | D21H 23/30<br>162/136 |

FOREIGN PATENT DOCUMENTS

| | | | |
|---|---|---|---|
| JP | 2014-034438 | A | 2/2014 |
| JP | 2016-207465 | A | 12/2016 |
| JP | 2018-174097 | A | 11/2018 |
| JP | 2020-068198 | A | 4/2020 |
| WO | 2018/128179 | A1 | 7/2018 |
| WO | 2019/009333 | A1 | 1/2019 |
| WO | 2019/177025 | A1 | 9/2019 |

* cited by examiner

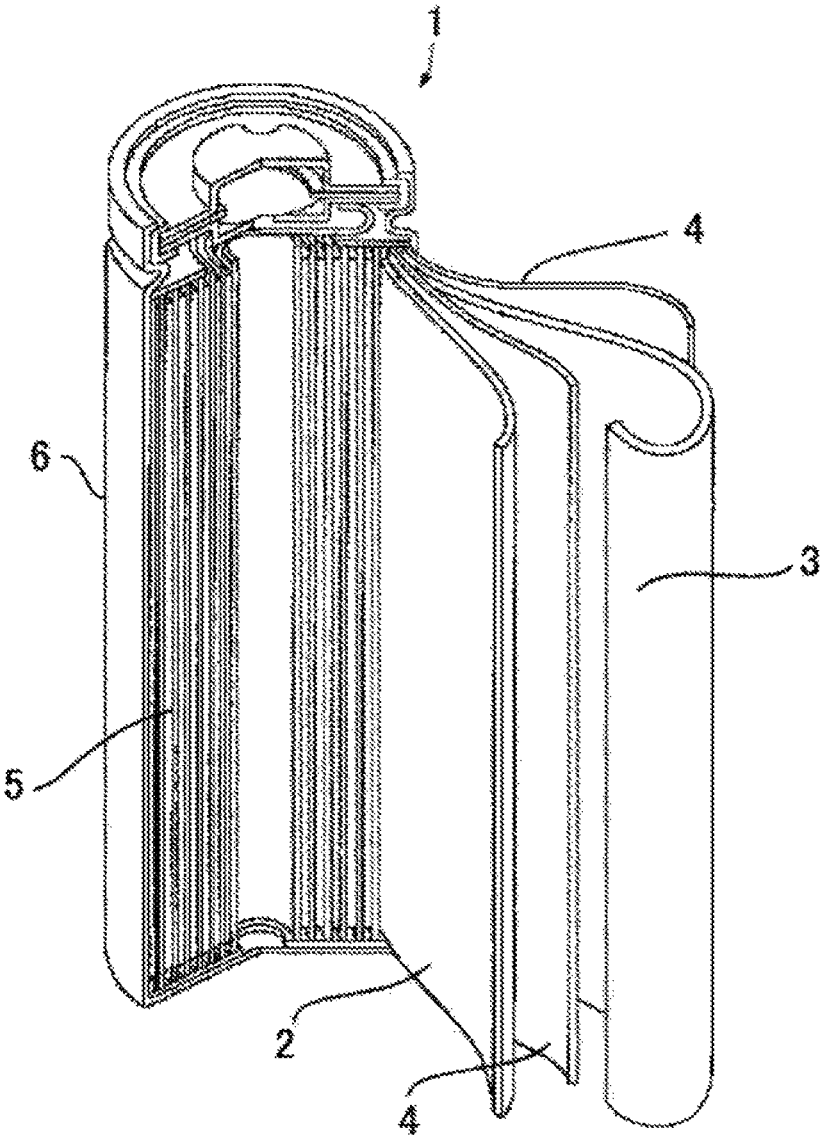
1
4
6
3
5
2
4

PACKAGED NEGATIVE ELECTRODE MATERIAL, METHOD FOR TRANSPORTING NEGATIVE ELECTRODE MATERIAL, CONTAINER FOR STORING NEGATIVE ELECTRODE MATERIAL, METHOD FOR STORING NEGATIVE ELECTRODE MATERIAL, AND METHOD FOR MANUFACTURING NEGATIVE ELECTRODE

TECHNICAL FIELD

The present invention relates to a packaged negative electrode material, a method for transporting a negative electrode material, a container for storing a negative electrode material, a method for storing a negative electrode material, and a method for manufacturing a negative electrode.

BACKGROUND ART

Lithium ion secondary batteries, characterized by lightweightness in weight and high energy density, are widely used as a power source of portable devices such as laptop computers and mobile phones. Further, lithium ion secondary batteries are used as a power source for automobiles and large-scale power storage systems for natural energy such as solar or wind-powered electricity.

As a negative electrode active material (hereinafter, also referred to as a negative electrode material) used for a negative electrode of a lithium ion secondary battery, carbon materials are widely used (see, for example, Patent Document 1).

PRIOR ART DOCUMENT

Patent Document

[Patent Document 1] International Publication No. 2018/128179

SUMMARY OF INVENTION

Problem to be Solved

The worldwide demand for lithium ion secondary batteries has greatly increased in recent years, and the transportation network for negative electrode materials has become more diversified. As a result, there are cases in which a negative electrode material is transported from the northern hemisphere to the southern hemisphere across the equator, and adverse effects on the quality of a negative electrode material due to harsh high-temperature and high-humidity conditions during transportation are an issue of growing concern.

In view of the foregoing, an embodiment of the present disclosure aims to provide a packaged negative electrode material with a suppressed degree of degradation of the negative electrode material during storage in a high-temperature and high-humidity environment; and a method for transporting the negative electrode material using the same.

A further embodiment of the present disclosure aims to provide a container for storing a negative electrode material, a method for storing a negative electrode material, and a method for manufacturing a negative electrode, with a suppressed degree of degradation of the negative electrode material during storage in a high-temperature and high-humidity environment.

Means for Solving Problem

The means for solving the problem includes the following embodiments.

<1> A packaged negative electrode material, comprising a container and a negative electrode material contained in the container, the container having a water vapor transmission rate of 150 g/($m^2$·d)(40° C./90% RH) or less, and the negative electrode material having a micropore volume of $0.40\times10^{-3}$ $m^3$/kg or less.

<2> The packaged negative electrode material according to <1>, wherein the container has a volume of from 6000 $cm^3$ to 40000 $cm^3$.

<3> The packaged negative electrode material according to <1> or <2>, wherein a filling ratio of the negative electrode material in the container is from 20% to 90%.

<4> The packaged negative electrode material according to any one of <1> to <3>, wherein the negative electrode material is a negative electrode material for a lithium ion secondary battery.

<5> The packaged negative electrode material according to any one of <1> to <4>, wherein the container comprises polyethylene.

<6> The packaged negative electrode material according to any one of <1> to <5>, wherein the container is deformable.

<7> A method for transporting a negative electrode material, the method comprising transporting the packaged negative electrode material according to any one of <1> to <6>.

<8> The method for transporting a negative electrode material according to <7>, wherein a manner of transportation is marine transport.

<9> A container for storing a negative electrode material, the container having a water vapor transmission rate of 150 g/($m^2$·d)(40° C./90% RH) or less, and the negative electrode material having a micropore volume of $0.40\times10^{-3}$ $m^3$/kg or less.

<10> A method for storing a negative electrode material, the method comprising storing a negative electrode material in a container, the container having a water vapor transmission rate of 150 g/($m^2$·d)(40° C./90% RH) or less, and the negative electrode material having a micropore volume of $0.40\times10^{-3}$ $m^3$/kg or less.

<11> A method for manufacturing a negative electrode, the method comprising:

extracting the negative electrode material from the container of the packaged negative electrode material according to any one of <1> to <6>; and manufacturing a negative electrode using the negative electrode material extracted from the container.

<12> The method for manufacturing a negative electrode according to <11>, wherein the extracting the negative electrode material from the container and the manufacturing a negative electrode using the negative electrode material extracted from the container are conducted consecutively.

Effect of Invention

According to an embodiment of the present disclosure, it is possible to provide a packaged negative electrode material with a suppressed degree of degradation of the negative electrode material during storage in a high-temperature and high-humidity environment; and a method for transporting the negative electrode material using the same.

According to a further embodiment of the present disclosure, it is possible to provide a container for storing a negative electrode material, a method for storing a negative electrode material, and a method for manufacturing a negative electrode, with a suppressed degree of degradation of the negative electrode material during storage in a high-temperature and high-humidity environment.

BRIEF DESCRIPTION OF DRAWING

FIG. 1 is a sectional view of a lithium ion secondary battery according to the present disclosure.

EMBODIMENT FOR CARRYING OUT INVENTION

Embodiments for carrying out the present invention will now be described in detail. However, the invention is in no way limited to the following embodiments.

In the following embodiments, constituent elements (including element steps and the like) of the embodiments are not essential, unless otherwise specified. Likewise, numerical values and ranges thereof are not intended to restrict the invention.

In the present disclosure, any numerical range described using the expression "from * to" represents a range in which numerical values described before and after the "to" are included in the range as a minimum value and a maximum value, respectively.

In a numerical range described in stages, in the present disclosure, an upper limit value or a lower limit value described in one numerical range may be replaced with an upper limit value or a lower limit value in another numerical range described in stages. Further, in a numerical range described in the present disclosure, the upper limit value or the lower limit value in the numerical range may be replaced with a value shown in the Examples.

In the present disclosure, each component may include plural kinds of substances corresponding to the component. In a case in which plural kinds of substances corresponding to each component are present in a composition, the content ratio or content of each component refers to the total content ratio or content of the plural kinds of substances present in the composition, unless otherwise specified.

In the present disclosure, particles corresponding to each component may include plural kinds of particles. In a case in which plural kinds of particles corresponding to each component are present in a composition, the particle size of each component refers to the value of the particle size of a mixture of the plural kinds of particles present in the composition, unless otherwise specified.

In the present disclosure, the term "layer" includes, when a region where a layer is present is observed, a case in which a layer is formed at a portion of the region, in addition to a case in which a layer is formed at an entire region.

In the present disclosure, the average thickness of a layer refers to an average value of thicknesses measured at arbitrarily selected 10 locations in the layer.

In the present disclosure, the term "solid content" of a positive electrode composition or a negative electrode composition refers to a remainder of a slurry of the positive electrode composition or the negative electrode composition from which a volatile component such as an organic solvent has been removed.

<Packaged Negative Electrode Material>

The packaged negative electrode material according to the present disclosure is a packaged negative electrode material, comprising a container and a negative electrode material contained in the container, the container having a water vapor transmission rate of 150 g/($m^2$·d)(40° C./90% RH) or less, and the negative electrode material having a micropore volume of $0.40\times10^{-3}$ $m^3$/kg or less.

According to research conducted by the present inventor, it has been found that degradation in quality of a negative electrode material during storage under high-temperature and high-humidity conditions is effectively suppressed when the negative electrode material has a micropore volume of $0.40\times10^{-3}$ $m^3$/kg or less and is contained in a container having a water vapor transmission rate of 150 g/($m^2$·d)(40° C./90% RH) or less.

While the reason for this remains somewhat unclear, it is thought that the effect on the characteristics of a negative electrode material imposed by the contact with water vapor under high-temperature and high-humidity conditions is small when the negative electrode material is a carbon material having a micropore volume of $0.40\times10^{-3}$ $m^3$/kg or less; and that the degradation of the negative electrode material is further suppressed by housing the material in a container having a water vapor transmission rate of 150 g/($m^2$·d)(40° C./90% RH) or less, in order to inhibit contact with water vapor.

(Negative Electrode Material)

The negative electrode material according to the present disclosure is not particularly limited, as long as it is a carbon material having a micropore volume of $0.40\times10^{-3}$ $m^3$/kg or less.

The type of the carbon material is not particularly limited, and may be a graphitic material or a non-graphitic material.

In the present disclosure, a graphitic material refers to a material having an interlayer distance ($d_{002}$), as measured by wide angle X-ray diffraction, of less than 0.340 nm, and a non-graphitic material refers to a material having an interlayer distance ($d_{002}$), as measured by wide angle X-ray diffraction, of 0.340 nm or more. A non-graphitic material having an interlayer distance ($d_{002}$) of from 0.340 nm to less than 0.350 nm may be referred to as soft carbon, and a non-graphitic material having an interlayer distance ($d_{002}$) of 0.350 nm or more may be referred to as hard carbon.

The interlayer distance ($d_{002}$) of a carbon material is an indicator for a degree of disorder in a crystal structure of the carbon material. The interlayer distance ($d_{002}$) can be calculated by a Bragg equation from a diffraction peak corresponding to the carbon 002 plane, which appears at a position at which a diffraction angle 2θ is approximately from 24° to 27° in a diffraction profile. The diffraction profile is obtained by exposing a specimen to X-rays (CuKα) and measuring a diffraction line with a goniometer. Specifically, the measurement of $d_{002}$ can be conducted under the following conditions.

Radiation source: CuKα (wavelength: 0.15418 nm)

Output power: 40 kV, 20 mA

Sampling width: 0.010°

Scanning range: 10° to 35°

Scanning rate: 0.5°/min

Bragg equation: $2d \sin \theta = n\lambda$

In the equation, d refers to a period length, n refers to an order of reflection, and λ refers to a wavelength of the X-ray.

The negative electrode material is preferably a graphitic carbon material having a particulate shape (hereinafter, also referred to as graphitic particles).

As the graphitic particles, it is possible to use graphitic particles obtained by pulverizing a natural graphite cake. Since graphitic particles obtained by pulverizing a natural graphite cake may include impurities, the graphitic particles are preferably subjected to a refining treatment.

The method for a refining treatment is not particularly limited, and may be selected from known processes for refinement. Examples of the method include flotation, electrochemical treatments, and chemical treatments.

The degree of purity of natural graphite is preferably 99.8% by mass or more (ash content: 0.2% by mass or less), more preferably 99.9% by mass or more (ash content: 0.1% by mass or less). When the degree of purity of natural graphite is 99.8% by mass or more, safety of a battery is more improved and battery properties tend to further improve.

The degree of purity of natural graphite may be calculated from the amount of residues derived from ash, which remains after placing 100 g of graphite in a furnace heated at 800° C. in an atmosphere for at least 48 hours, for example.

It is possible to use graphitic particles obtained by pulverizing artificial graphite, which is obtained by calcining a resin-based material such as epoxy resin or phenol resin, or a pitch-based material obtained from petroleum, coal or the like.

The method for obtaining artificial graphite is not particularly limited, and examples thereof include a method of calcining a raw material, such as a thermoplastic resin, naphthalene, anthracene, phenanthroline, coal tar or tar pitch, in an inert atmosphere at a temperature of 800° C. or more. The calcined product is pulverized with a known means such as a jet mill, a vibrating mill, a pin mill or a hammer mill for adjusting the average particle size to a range of approximately from 2 μm to 40 μm, thereby obtaining graphitic particles originating from artificial graphite. It is possible to subject a raw material to a thermal treatment prior to calcination.

In a case in which a raw material is subjected to a thermal treatment, graphite particles originating from artificial graphite may be obtained by, for example, subjecting the raw material to a thermal treatment with an autoclave or the like, roughly pulverizing the raw material after the thermal treatment with a known means, prior to the processes of calcining the raw material in an inert atmosphere at a temperature of 800° C. and pulverizing the calcined product for adjusting the average particle size to a range of approximately from 2 μm to 40 μm, as mentioned above.

In the present disclosure, the micropore volume of the negative electrode material is calculated from the amount of adsorption of a $CO_2$ gas measured at 0° C. with an automatic gas adsorption/desorption analyzer.

The micropore volume of the negative electrode material may be $0.40\times10^{-3}$ $m^3$/kg or less, $0.35\times10^{-3}$ $m^3$/kg or less, or $0.30\times10^{-3}$ $m^3$/kg or less.

The smaller the micropore volume of the negative electrode material is, the more the storage characteristic of a battery tends to improve.

The micropore volume of the negative electrode material may be $0.05\times10^{-3}$ $m^3$/kg or more, $0.07\times10^{-3}$ $m^3$/kg or more, or $0.09\times10^{-3}$ $m^3$/kg or more.

The greater the micropore volume of the negative electrode material is, the more the input characteristic of a battery tends to improve.

The micropore volume of the negative electrode material may be adjusted by the type of a precursor for a low-crystalline carbon, the temperature for a thermal treatment, the amount of a low-crystalline carbon, or the like.

The volume average particle size of the negative electrode material is preferably from 2 μm to 30 μm, more preferably from 2.5 μm to 25 μm, further preferably from 3 μm to 20 μm, yet further preferably from 5 μm to 20 μm. When the volume average particle size of the negative electrode material is 30 μm or less, a battery tends to exhibit improved discharge capacity and discharge properties. When the volume average particle size of the negative electrode material is 2 μm or more, a battery tends to exhibit improved initial charge/discharge properties.

In the present disclosure, the volume average particle size of the negative electrode material refers to a median size (d50) in a volume-based particle size distribution obtained by a laser diffraction/scattering method.

The negative electrode material preferably has a BET specific surface area of from 0.8 $m^2$/g to 8 $m^2$/g, more preferably from 1 $m^2$/g to 7 $m^2$/g, further preferably from 1.5 $m^2$/g to 6 $m^2$/g, yet further preferably from 2 $m^2$/g to 6 $m^2$/g.

When the BET specific surface area of the negative electrode material is 0.8 $m^2$/g or more, a battery tends to exhibit excellent performances. When the BET specific surface area of the negative electrode material is 8 $m^2$/g or less, the negative electrode material tends to have a high degree of tap density, and tends to be mixed favorably with other materials such as a binder and a conductive agent.

The BET specific surface area of the negative electrode material may be measured from a nitrogen adsorption property according to JIS Z 8830:2013. The measurement device may be AUTOSORB-1 (trade name), Quantachrome. Since a gas adsorption property of a sample material may be affected by moisture, which is adsorbing to a surface or inside of a sample material, a pretreatment for removing moisture by heat is performed prior to measuring the BET specific surface area. After the pretreatment, the BET specific surface area of the sample material is measured at a temperature of 77K and a pressure range of less than 1 with respect to a relative pressure (a balance pressure to saturated vapor pressure).

In the pretreatment, a measurement cell containing 0.05 g of a sample material is decompressed to have an inner pressure of 10 Pa or less with a vacuum pump, and then heated at 110° C. for 3 hours or more. Subsequently, the measurement cell is naturally cooled down to an ordinary temperature (25° C.) while maintaining a decompressed state.

The negative electrode material may be in a state in which a layer of a carbon material with a lower degree of crystallinity than graphite (low-crystalline carbon layer) is formed on a surface of graphite particles as a core.

When graphitic particles have a low-crystalline carbon layer on a surface thereof, the mass ratio of the low-crystalline carbon layer with respect to 1 part by mass of graphite is preferably from 0.005 to 10, more preferably from 0.005 to 5, further preferably from 0.005 to 0.08. When the mass ratio is 0.005 or more, a battery tends to exhibit excellent initial charge/discharge efficiency and lifetime characteristics. When the mass ratio is 10 or less, a battery tends to exhibit excellent output properties.

When the graphitic particles includes graphite and a component other than graphite, the contents of graphite and a component other than graphite may be calculated from a rate of decrease in weight at a temperature range of from 500° C. to 600° C. by measuring a change in weight in an air stream by TG-DTA (Thermogravimetry-Differential Thermal Analysis). The change in weight at a temperature range of 500° C. to 600° C. may be attributed to a change in weight of a material other than graphite, and the remainder after the thermal treatment may be attributed to the amount of graphite.

The method for producing graphitic particles having a low-crystalline carbon layer on a surface of graphite particles as a core is not particularly limited. For example, the graphitic particles are preferably produced by a method including subjecting a mixture including graphite particles and a precursor of a low-crystalline carbon layer. According to the method, graphitic particles can be produced in an efficient manner.

Examples of the precursor for a low-crystalline carbon layer is not particularly limited, and examples thereof include pitches and organic polymer compounds.

Examples of the pitches include ethylene-heavy-end pitch, crude-oil pitch, coal-tar pitch, asphalt-decomposed pitch, pitches obtained by thermal decomposition of polyvinyl chloride or the like, and pitches obtained by polymerization of naphthalene or the like under the presence of a super-strong acid.

Examples of the organic polymer compounds include thermoplastic resins such as polyvinyl chloride, polyvinyl alcohol, polyvinyl acetate and polyvinyl butyral, and natural products such as starch and cellulose.

The temperature for the thermal treatment of the mixture is not particularly limited. From the viewpoint of improving the input/output characteristics of a lithium ion secondary battery, the temperature is preferably from 900° C. to 1500° C.

In the method, the contents of graphite particles and a precursor for a low-crystalline carbon layer in the mixture prior to the thermal treatment is not particularly limited. From the viewpoint of improving the input/output characteristics of a lithium ion secondary battery, the content of graphite particles as a core is preferably from 85% by mass to 99.9% by mass with respect to the total mass of the mixture.

The Raman R value (ID/IG) of the negative electrode material is preferably from 0.10 to 0.60, more preferably from 0.15 to 0.55, further preferably from 0.20 to 0.50, yet further preferably from 0.25 to 0.40.

The Raman R value (ID/IG) of the negative electrode material refers to a ratio of ID, which is a peak intensity measured at a range of from 1300 $cm^{-1}$ to 1400 $cm^{-1}$ to IG, which is a peak intensity measured at a range of from 1580 $cm^{-1}$ to 1620 $cm^{-1}$, in a Raman spectrum obtained by exposing the negative electrode material to a laser light of 532 nm.

The Raman spectrum may be measured with a Raman spectrometer (such as DXR, Thermo Fisher Scientific).

(Container)

The container for storing the negative electrode material is not particularly limited, as long as it has a water vapor transmission rate of 150 $g/(m^2 \cdot d)$(40° C./90% RH) or less.

The water vapor transmission rate in the present disclosure is measured by an infrared detection sensor method as stipulated in JIS K7129-2:2019.

In the present disclosure, "store" refers to disposing a negative electrode material within a closed space, and "container" refers to an object that can dispose a negative electrode material within a closed space.

Examples of the material for the container include resin, rubber, metal and carbon. The container may be made from a single kind of material or two or more kinds of materials in combination.

Examples of the resin include polyolefin such as polyethylene and polypropylene, polyester such as polyethylene terephthalate and polycarbonate, polystyrene, polyamide, polyimide, polyether imide, polyurethane, polyvinyl chloride, acrylic resin, epoxy resin, silicone resin and thermoplastic elastomers. Among these resins, polyethylene is preferred.

As necessary, the container may have a gas-barrier coating at a surface thereof. Examples of the gas-barrier coating include a coating including an inorganic material such as metal, silica, alumina or carbon.

The volume of the container may be 6000 $cm^3$ or more, 8000 $cm^3$ or more, or 10000 $cm^3$ or more. The greater the volume of the container is, the greater the loading efficiency of the container tends to be.

The volume of the container may be 40000 $cm^3$ or less, 35000 $cm^3$ or less, or 30000 $cm^3$ or less. The smaller the volume of the container is, the easier the transportation of the container tends to be.

The filling ratio of the negative electrode material in the container is not particularly limited, and may be 20% or more, 25% or more, or 50% or more. The greater the filling ratio of the negative electrode material is, the greater the loading efficiency of the container tends to be.

The filling ratio of the negative electrode material in the container is not particularly limited, and may be 90% or less, 85% or less, or 80% or less. The smaller the filling ratio of the negative electrode is, the easier the transportation of the container tends to be.

The filling ratio of the negative electrode material refers to a proportion (%) of a volume of a negative electrode material in a container ($cm^3$) with respect to a volume of the container ($cm^3$).

The shape of the container is not particularly limited. For example, the container may have a cylindrical shape, a cubic shape, or a bag-like shape (such as a flexible container).

As necessary, the container may have a multi-layer structure such as a double-layer structure.

Examples of the container having a multi-layer structure include a flexible container having an outer bag and an inner bag being made of metal such as aluminum. When the container has a multi-layer structure, at least one layer satisfies the requirement of water vapor transmission rate as mentioned above.

The container may be deformable or not deformable. When the purpose of the container is transportation of a negative electrode material (in particular, long-distance transportation such as import/export), the container is preferably deformable. Examples of the deformable container include a bag-like container such as a flexible container.

The negative electrode material, included in the packaged negative electrode material, is used for producing a negative electrode for a lithium ion secondary battery, for example.

The configuration of a lithium ion secondary battery is not specifically limited, and may be selected from known configurations. In an embodiment, a lithium ion secondary battery has a negative electrode that includes a negative electrode material as mentioned above, a positive electrode that includes a positive active material, a separator that is disposed between the positive electrode and the negative electrode, and a non-aqueous electrolyte.

The following are the details of the positive electrode, negative electrode, non-aqueous electrolyte, separator and other components that may be used as necessary.

(Positive Electrode)

The positive electrode (positive electrode plate) has a current collector (positive-electrode current collector) and a positive-electrode composition layer that is disposed onto a surface of the current collector. The positive-electrode composition layer refers to a layer that is disposed at a surface of a current collector and includes at least a positive-electrode active material.

The positive electrode preferably includes a lamellar lithium/nickel/manganese/cobalt composite oxide (also referred to as NMC) as a positive-electrode active material. A battery using NMC tends to have a high degree of capacity and safety.

In view of a further improvement in safety, the positive electrode preferably includes a combination of NMC and a spinel lithium/manganese composite oxide (hereinafter, also referred to as sp-Mn) as a positive-electrode active material.

From the viewpoint of increasing the battery capacity, the content of NMC is preferably 65% by mass or more, more preferably 70% by mass or more, further preferably 80% by mass or more, with respect to a total amount of the positive-electrode composition layer.

The NMC is preferably a composite oxide represented by the following formula.

$$Li_{(1+\delta)}Mn_xNi_yCo_{(1-x-y-z)}M_zO_2$$

In the formula, (1+δ), x, y and (1−x−y−z) refer to composite ratios of Li (lithium), Mn (manganese), Ni (nickel) and Co (cobalt), respectively, and z refers to a composite ratio of element M. The composite ratio of O (oxygen) is 2.

M refers to at least one element selected from the group consisting of Ti (titanium), Zr (zirconium), Nb (niobium), Mo (molybdenum), W (tungsten), Al (aluminum), Si (silicon), Ga (gallium), Ge (germanium) and Sn (tin).

The formula satisfies the following conditions: $-0.15<\delta<0.15$, $0.1<x\leq0.5$, $0.6<x+y+z<1.0$ and $0\leq z\leq0.1$.

The sp-Mn is preferably a composite oxide represented by the following formula.

$$Li_{(1+\eta)}Mn_{(2-\lambda)}M'_{\lambda}O_4$$

In the formula, (1+η), (2−λ) and λ refer to composite ratios of Li (lithium), Mn (manganese) and element M', respectively. The composite ratio of O (oxygen) is 4.

M' refers to at least one element selected from the group consisting of Ca (calcium), Sr (strontium), Al, Ga, Zn (zinc) and Cu (copper).

The formula satisfies the following conditions: $0\leq\eta\leq0.2$ and $0\leq\lambda\leq0.1$.

M' is preferably Mg or Al. When M' is Mg or Al, a battery tends to achieve improved lifetime characteristics and safety. Further, addition of element M' reduces the amount of elution of Mn, thereby improving storage and charge/discharge properties of a battery.

Materials other than NMC and sp-Mn may be used as a positive-electrode active material.

Examples of a positive-electrode active material other than NMC and sp-Mn include lithium-containing composite metal oxides other than NMC and sp-Mn; olivine lithium salts; chalcogen compounds; and manganese dioxide.

The lithium-containing composite metal oxide is a metal oxide including lithium and a transition metal, or a metal oxide including lithium, a transition metal, and a different element that substitutes a part of the transition metal.

Examples of the different element Na, Mg, Sc, Y, Mn, Fe, Co, Ni, Cu, Zn, Al, Cr, Pb, Sb, V and B, preferably Mn, Al, Co, Ni and Mg. The lithium-containing composite metal oxide may include a single kind of different element, or may include two or more kinds in combination.

Examples of the lithium-containing composite metal oxide other than NMC and sp-Mn include $Li_xCoO_2$, $Li_xNiO_2$, $Li_xMnO_2$, $Li_xCo_yNi_{1-y}O_2$, $Li_xCo_yM^1_{1-y}O_z$ (in $Li_xCoyM^1_{1-y}O_z$, $M^1$ is at least one element selected from Na, Mg, Sc, Y, Mn, Fe, Ni, Cu, Zn, Al, Cr, Pb, Sb, V and B), $Li_xNi_{1-y}M^2_yO_z$ (in $Li_xNi_{1-y}M^2_yO_z$, $M^2$ is at least one element selected from Na, Mg, Sc, Y, Mn, Fe, Co, Cu, Zn, Al, Cr, Pb, Sb, V and B), wherein $0<x\leq1.2$, y is from 0 to 0.9, z is from 2.0 to 2.3. In the chemical formulas, x refers to a molar ratio of lithium, which is variable by a state of charging or discharging.

Examples of the olivine lithium salt include $LiFePO_4$.

Examples of the chalcogen compound include titanium disulfide and molybdenum disulfide.

The positive electrode may include a single kind of positive-electrode active material, or may include two or more kinds in combination.

In the following, details of the positive-electrode composition layer and the current collector are explained.

The positive-electrode composition layer includes a positive-electrode active material and a binder or the like, and is disposed on a current collector. The method for forming the positive-electrode composition layer is not particularly limited. For example, the positive-electrode composition layer may be formed by forming a sheet of a composition including a positive-electrode active material, a binder, and optional components such as a conductive agent, a thickener and the like by a dry process, and attaching the sheet to a current collector (dry method). Alternatively, the positive-electrode composition layer may be formed by preparing a slurry of a positive-electrode composition by dissolving or dispersing a positive-electrode active material, a binder, and optional components such as a conductive agent, with a solvent, and applying the slurry to a current collector and drying (wet method).

As the positive-electrode active material, a lamellar lithium/nickel/manganese/cobalt composite oxide (NMC) is preferably used. The positive-electrode active material is used in a powdery (particulate) form and mixed with other materials.

The particles of positive-electrode active material such as NMC or sp-Mn may have a lampy shape, polyhedral shape, spherical shape, oval shape, plate-like shape, needle-like shape or rod-like shape.

The average particle size (d50) of the particles of positive-electrode active material such as NMC or sp-Mn (when the particles is in the form of secondary particles formed of primary particles, the average particle size (d50) of the secondary particles is regarded as the average particle size of the positive-electrode active material) is preferably from 1 μm to 30 μm, more preferably from 3 μm to 25 μm, further preferably from 5 μm to 15 μm, from the viewpoint of tap density (fillability) and mixability with other materials in the formation of an electrode. The average particle size (d50) of the particles of positive-electrode active material may be measured in the same manner as the graphitic particles.

The BET specific surface area of the particles of positive-electrode active material such as NMC or sp-Mn is preferably from 0.2 $m^2/g$ to 4.0 $m^2/g$, more preferably from 0.3 $m^2/g$ to 2.5 $m^2/g$, further preferably from 0.4 $m^2/g$ to 1.5 $m^2/g$.

When the BET specific surface area of the particles of positive-electrode active material is 0.2 $m^2/g$ or more, a battery tends to achieve excellent battery performances. When the BET specific surface area of the particles of positive-electrode active material is 4.0 $m^2/g$ or less, the particles of positive-electrode active material tend to have a high degree of tap density and are mixed favorably with other materials such as a binder or a conductive agent. The BET specific surface area of the particles of positive-electrode active material may be measured in the same manner as the graphitic particles.

Examples of the conductive agent include metal materials such as copper and nickel and carbon materials. The carbon materials include graphite such as natural graphite and artificial graphite, carbon black such as acetylene black, and amorphous carbon such as needle coke. A single kind of the conductive agent may be used, or two or more kinds thereof may be used in combination.

The content of the conductive agent with respect to the mass of the positive-electrode composition layer is preferably from 0.01% by mass to 50% by mass, more preferably from 0.1% by mass to 30% by mass, further preferably from 1% by mass to 15% by mass. When the content of the conductive agent is 0.01% by mass or more, a positive-electrode composition layer tends to achieve a sufficient degree of conductivity. When the content of the conductive agent is 50% by mass or less, a decrease in battery capacity tends to be suppressed.

The binder for the positive electrode is not particularly limited, and may be selected from materials having favorable dissolvability or dispersibility with respect to a solvent in a case of forming a positive-electrode composition layer by a wet method.

Specific examples of the binder include resin-type polymers such as polyethylene, polypropylene, polyethylene terephthalate, polyimide and cellulose; rubber-type polymers such as SBR (styrene-butadiene rubber) and NBR (acrylonitrile-butadiene rubber); fluorine-type polymers such as polyvinylidene fluoride (PVdF), polytetrafluoroethylene, polytetrafluoroethylene/vinylidene fluoride copolymer, and fluorinated polyvinylidene fluoride; and polymer compositions being conductive to alkali metal ions (especially lithium ions). A single kind of the binder for positive electrode may be used, or two or more kinds thereof may be used in combination.

From the viewpoint of stability of a positive electrode, fluorine-type polymers such as polyvinylidene fluoride (PVdF) and polytetrafluoroethylene are preferred as the binder.

The content of the binder with respect to the mass of the positive-electrode composition layer is preferably from 0.1% by mass to 60% by mass, more preferably from 1% by mass to 40% by mass, further preferably from 3% by mass to 10% by mass.

When the content of the binder is 0.1% by mass or more, it is possible to sufficiently bind the positive-electrode active material, thereby achieving a sufficient degree of mechanical strength of the positive-electrode composition layer and improving the battery performance such as cycle characteristics. When the content of the binder is 60% by mass or less, a sufficient degree of battery capacity and conductivity tend to be achieved.

The thickening agent is effective for adjusting the viscosity of a slurry. The thickening agent is not specifically limited, and specific examples thereof include carboxymethyl cellulose, methyl cellulose, hydroxymethyl cellulose, ethyl cellulose, polyvinyl alcohol, oxidized starch, phosphorylated starch, casein and a salt of these materials. A single kind of the thickening agent may be used, or two or more kinds thereof may be used in combination.

The content of the thickening agent with respect to the mass of positive-electrode composition layer is preferably from 0.1% by mass to 20% by mass, more preferably from 0.5% by mass to 15% by mass, further preferably from 1% by mass to 10% by mass, from the viewpoint of input/output properties and battery capacity.

The solvent used for preparing a slurry is not particularly limited, as long as it can dissolve or disperse a positive-electrode active material, a binder, and optional components such as a conductive agent or a thickening agent. The solvent may be either an aqueous solvent or an organic solvent. Examples of the aqueous solvent include water, alcohol and a mixed solvent of water and alcohol. Examples of the organic solvent include N-methyl-2-pyrrolidone (NMP), dimethyl formamide, dimethyl acetamide, methyl ethyl ketone, cyclohexanone, methyl acetate, methyl acrylate, tetrahydrofuran (THF), toluene, acetone, diethyl ether, dimethyl sulfoxide, benzene, xylene and hexane.

The thickening agent is preferably used especially in a case of using an aqueous solvent.

The positive-electrode composition layer formed on a current collector by a wet method or a dry method is preferably subjected to compression by hand pressing, roller pressing, or the like.

The density of the positive-electrode composition layer after the compression is preferably from 2.5 $g/cm^3$ to 3.5 $g/cm^3$, more preferably from 2.55 $g/cm^3$ to 3.15 $g/cm^3$, further preferably from 2.6 $g/cm^3$ to 3.0 $g/cm^3$, from the viewpoint of further improvements in input/output properties and safety.

The amount of the positive-electrode composition to apply to a current collector as a solid content is preferably from 30 g/m 2 to 170 $g/m^2$, more preferably from 40 g/m 2 to 160 $g/m^2$, further preferably from 40 g/m 2 to 150 $g/m^2$, for one side of the current collector, from the viewpoint of energy density and input/output properties.

In view of the amount of the positive-electrode composition to apply to a current collector and the density of the positive-electrode composition layer, the average thickness of the positive-electrode composition layer is preferably from 19 μm to 68 μm more preferably from 23 μm to 64 μm further preferably from 36 μm to 60 μm.

The material for the current collector for positive electrode is not particularly limited. The material is preferably a metal material, more preferably aluminum.

Examples of the current collector include metal foils, metal plates, metal films and expanded metal meshes. Among these, metal foils are preferably used. It is possible to use a mesh-type metal film.

The average thickness of the current collector is not particularly limited. From the viewpoint of imparting a sufficient degree of strength and a sufficient degree of flexibility to a current collector, the average thickness is preferably from 1 μm to 1 mm, more preferably from 3 μm to 100 μm, further preferably from 5 μm to 100 μm.

(Negative Electrode)

The negative electrode (negative-electrode plate) has a current collector (negative-electrode current collector) and a negative-electrode composition layer that is disposed on the current collector. The negative-electrode composition layer is a layer that is disposed on a current collector and includes a negative-electrode active material. The negative electrode of the present disclosure may be used as a negative electrode of the lithium ion secondary battery of the present disclosure.

The method for forming the negative-electrode composition layer is not particularly limited. For example, the negative-electrode composition layer may be formed by preparing a slurry of a negative-electrode composition by dissolving or dispersing a negative-electrode active material, a binder, and optional components such as a conductive agent or a thickening agent, with a solvent, and applying the slurry to a current collector and drying (wet method).

Examples of the conductive agent include graphite other than the graphite particles according to the negative electrode material of the present disclosure, such as natural graphite and artificial graphite, carbon black such as acetylene black, and amorphous carbon such as needle coke. A single kind of the conductive agent may be used, or two or more kinds thereof may be used in combination. Addition of a conductive agent tends to exhibit an effect of reducing a resistance in the electrode.

The content of the conductive agent with respect to the mass of the negative-electrode composition layer is preferably from 1% by mass to 45% by mass, more preferably from 2% by mass to 42% by mass, further preferably from 3% by mass to 40% by mass, from the viewpoint of improving the conductivity and reducing the initial irreversible capacity of a battery.

When the content of the conductive agent is 1% by mass or more, a sufficient degree of conductivity tends to be achieved. When the content of the conductive agent is 45% by mass or less, a decrease in battery capacity tends to be suppressed.

Specific examples of the binder include resin-type polymers such as polyethylene, polypropylene, polyethylene terephthalate, cellulose and nitrocellulose; rubber-type polymers such as SBR (styrene-butadiene rubber) and NBR (acrylonitrile-butadiene rubber); fluorine-type polymers such as polyvinylidene fluoride (PVdF), polytetrafluoroethylene and fluorinated polyvinylidene fluoride; and polymer compositions being conductive to alkali metal ions (especially lithium ions). From the viewpoint of stability of a positive electrode, the binder is preferably SBR or fluorine-type polymers such as polyvinylidene fluoride.

A single kind of the binder for negative electrode may be used, or two or more kinds thereof may be used in combination.

The content of the binder with respect to the mass of the negative-electrode composition layer is preferably from 0.1% by mass to 20% by mass, more preferably from 0.5% by mass to 15% by mass, further preferably from 0.6% by mass to 10% by mass.

When the content of the binder is 0.1% by mass or more, it is possible to sufficiently bind the negative-electrode active material, thereby imparting a sufficient degree of mechanical strength to the negative-electrode composition layer. When the content of the binder is 20% by mass or less, the negative electrode tends to achieve a sufficient degree of capacity and a sufficient degree of conductivity.

When a fluoline-type polymer such as polyvinylidene fluoride is used as a major component of the binder, the content of the binder with respect to the mass of the negative-electrode composition layer is preferably from 1% by mass to 15% by mass, more preferably from 2% by mass to 10% by mass, further preferably from 3% by mass to 8% by mass.

The thickening agent is used for adjusting the viscosity of a slurry. The thickening agent is not specifically limited, and examples thereof include carboxymethyl cellulose, methyl cellulose, hydroxymethyl cellulose, ethyl cellulose, polyvinyl alcohol, oxidized starch, phosphorylated starch, casein and a salt of these materials. A single kind of the thickening agent may be used, or two more kinds may be used in combination.

The content of the thickening agent with respect to the mass of the negative-electrode composition layer is preferably from 0.1% by mass to 5% by mass, more preferably from 0.5% by mass to 3% by mass, further preferably from 0.6% by mass to 2% by mass, from the viewpoint of the input/output properties and capacity of a battery.

The solvent used for preparing a slurry is not particularly limited, as long as it can dissolve or disperse a negative-electrode active material, a binder, and optional components such as a conductive agent or a thickening agent. The solvent may be either an aqueous solvent or an organic solvent. Examples of the aqueous solvent include water, alcohol and a mixed solvent of water and alcohol. Examples of the organic solvent include N-methyl-2-pyrrolidone (NMP), dimethyl formamide, dimethyl acetamide, methyl ethyl ketone, cyclohexanone, methyl acetate, methyl acrylate, tetrahydrofuran (THF), toluene, acetone, diethyl ether, dimethyl sulfoxide, benzene, xylene and hexane. The thickening agent is preferably used especially in a case of using an aqueous solvent.

The density of the negative-electrode composition layer is preferably from 0.7 g/cm$^3$ to 2 g/cm$^3$, more preferably from 0.8 g/cm$^3$ to 1.9 g/cm$^3$, further preferably from 0.9 g/cm$^3$ to 1.8 g/cm$^3$.

When the density of the negative-electrode composition layer is 0.7 g/cm$^3$ or more, it is possible to improve the conductivity in the negative-electrode active material and suppress an increase in battery resistance, thereby improving the capacity per volume. When the density of the negative-electrode composition layer is 2 g/cm$^3$ or less, it is possible to reduce a risk of degradation of discharge properties, which is caused by an increase in initial irreversible capacity and a decrease in permeability of a non-aqueous electrolyte at an interface of a current collector and a negative-electrode active material.

The amount of the negative-electrode composition to apply to a current collector as a solid content is preferably from 30 g/m 2 to 150 g/m$^2$, more preferably from 40 g/m 2 to 140 g/m$^2$, further preferably from 45 g/m 2 to 130 g/m$^2$, for one side of the current collector.

In view of the amount of the negative-electrode composition to apply to a current collector and the density of the negative-electrode composition layer, the average thickness of the negative-electrode composition layer is preferably from 10 nm to 150 nm, more preferably from 15 nm to 140 nm, further preferably from 15 nm to 120 nm.

The material for the current collector for the negative electrode is not particularly limited, and examples thereof include metal materials such as copper, nickel, stainless steel and nickel-plated steel. From the viewpoint of ease of processing and production costs, copper is preferred.

Examples of the current collector include metal foils, metal plates, metal films and expanded metal meshes. Among these, metal films are preferred and copper foils are more preferred. The copper foils include rolled copper foils obtained by a roll method and electrolytic copper foils obtained by an electrolytic method, and either one of them may be suitably used as a current collector.

The average thickness of the current collector is not particularly limited. For example, the average thickness is preferably from 5 μm to 50 nm, more preferably from 8 μm to 40 nm, further preferably from 9 μm to 30 nm.

When the average thickness of the current collector is less than 25 nm, it is possible to improve the strength of the current collector by using a copper alloy such as phosphor bronze, titanium copper, Corson alloy and Cu—Cr—Zr alloy, rather than pure copper.

(Non-Aqueous Electrolyte)

The non-aqueous electrolyte generally includes a non-aqueous solvent and a lithium salt (electrolyte).

Examples of the non-aqueous solvent include cyclic carbonates, linear carbonates and cyclic sulfonic esters.

The cyclic carbonate preferably has an alkylene group constituting the cyclic carbonate with a carbon number of from 2 to 6, more preferably from 2 to 4, and examples thereof include ethylene carbonate, propylene carbonate and butylene carbonate. Among these, ethylene carbonate and propylene carbonate are preferred.

The linear carbonate is preferably a dialkyl carbonate, having two alkyl groups with a carbon number of preferably from 1 to 5, more preferably from 1 to 4, respectively, and examples thereof include symmetric linear dimethyl carbonates such as diethyl carbonate and di-n-propyl carbonate; and asymmetric linear carbonates such as ethyl methyl carbonate, methyl-n-propyl carbonate and ethyl-n-propyl carbonate. Among these, dimethyl carbonate and ethyl methyl carbonate are preferred.

The use of dimethyl carbonate tends to improve cycle characteristics more than diethyl carbonate, since dimethyl carbonate is more resistant to oxidation and reduction than diethyl carbonate.

The use of ethyl methyl carbonate tends to improve the low-temperature characteristics of a battery, due to an asymmetry molecular structure and a low melting point thereof.

It is especially preferred to use a mixed solvent of ethylene carbonate, dimethyl carbonate and ethyl methyl carbonate in view of securing the battery properties over a wide temperature range.

The content of a cyclic carbonate and a linear carbonate is preferably 85% by mass or more, more preferably 90% by mass or more, further preferably 95% by mass or more, with respect to the total amount of the non-aqueous solvent.

When a cyclic carbonate and a linear carbonate are used in combination, the mixed ratio thereof (cyclic carbonate/linear carbonate, by volume) is preferably from 1/9 to 6/4, more preferably from 2/8 to 5/5.

Examples of the cyclic sulfonic ester include 1,3-propane sultone, 1-methyl-1,3-propane sultone, 3-methyl-1,3-propane sultone, 1,4-butane sultone, 1,3-propene sultone and 1,4-butene sultone. Among these, 1,3-propane sultone and 1,4-butane sultone are preferred in view of reducing the direct-current resistance.

The non-aqueous electrolyte may further include a linear ester, a cyclic ester, a linear ether, a cyclic sulfone, or the like.

Example of the linear ester include methyl acetate, ethyl acetate, propyl acetate and methyl propionate. Among these, methyl acetate is preferred from the viewpoint of improving the low-temperature characteristics.

Examples of the cyclic ether include tetrahydrofuran, 2-methyl tetrahydrofuran, and tetrahydropyran.

Examples of the linear ether include dimethoxyethane and dimethoxymethane.

Examples of the cyclic sulfone include sulfolane and 3-methylsulfolane.

The non-aqueous electrolyte may include a silyl phosphate.

Examples of the silyl phosphate include tris(trimethylsilyl) phosphate, dimethyl(trimethylsilyl) phosphate, methyl bis(trimethylsilyl) phosphate, diethyl(trimethylsilyl) phosphate, ethyl bis(trimethylsilyl) phosphate, dipropyl(trimethylsilyl) phosphate, propyl bis(trimethylsilyl) phosphate, dibutyl(trimethylsilyl) phosphate), butyl bis(trimethylsilyl) phosphate, dioctyl (trimethylsilyl) phosphate, octyl bis(trimethylsilyl) phosphate, diphenyl(trimethylsilyl) phosphate, phenyl bis(trimethylsilyl) phosphate, di(trifluoroethyl) (trimethylsilyl) phosphate, trifluoroethyl bis(trimethylsilyl) phosphate, compounds in which a trimethylsilyl group of these (trimethylsilyl) phosphates is substituted with a triethylsilyl group, a triphenylsilyl group, a t-butyldimethylsilyl group or the like, and compounds having a condensed phophate structure in which phosphorus atoms are bonded via an oxygen atom by condensation of phosphates.

Among these, tris(trimethylsilyl) phosphate (TMSP) is preferably used. It is possible to suppress an increase in resistance by tris(trimethylsilyl) phosphate with a smaller amount of addition, as compared with other (trimethylsilyl) phosphates.

A single kind of the tris(trimethylsilyl) phosphate may be used, or two or more kinds thereof may be used in combination.

When the non-aqueous electrolyte includes a tris(trimethylsilyl) phosphate, the content thereof is preferably from 0.1% by mass to 5% by mass, more preferably from 0.3% by mass to 3% by mass, further preferably from 0.4% by mass to 2% by mass, with respect to the total amount of non-aqueous electrolyte.

In particular, when the non-aqueous electrolyte includes TMSP, the content thereof is preferably from 0.1% by mass to 0.5% by mass, more preferably from 0.1% by mass to 0.4% by mass, further preferably from 0.2% by mass to 0.4% by mass, with respect to the total amount of non-aqueous electrolyte. When the content of TMSP is within the above range, lifetime properties tend to improve by the action of a thin SEI (solid electrolyte interphase) or the like.

The non-aqueous electrolyte may include vinylene carbonate (VC). By using VC, a stable coating film is formed on a surface of the negative electrode during the charging of a lithium ion secondary battery. The coating film has an effect of suppressing decomposition of a non-aqueous electrolyte at a surface of the negative electrode.

The content of vinylene carbonate is preferably from 0.3% by mass to 1.6% by mass, more preferably from 0.3% by mass to 1.5% by mass, further preferably from 0.3% by mass to 1.3% by mass, with respect to the total amount of a non-aqueous electrolyte. When the content of vinylene carbonate is within the above range, lifetime properties tend to improve and a decrease in charge/discharge efficiency, which is caused by decomposition of excessive VC during the charging of a lithium ion secondary battery, tends to be suppressed.

In the following, the lithium salt (electrolyte) is explained.

The lithium salt is not particularly limited as long as it is usable as an electrolyte for a non-aqueous electrolyte for a lithium ion secondary battery, and examples thereof include inorganic lithium salts, fluorine-containing organic lithium salts, and oxalato borates.

Examples of the organic lithium salt include inorganic fluoride salts such as $LiPF_6$, $LiBF_4$, $LiAsF_6$ and $LiSbF_6$, perhalogen acid salts such as $LiClO_4$, $LiBrO_4$ and $LiIO_4$, and inorganic chloride salts such as $LiAlCl_4$.

Examples of the fluorine-containing organic lithium salt include perfluoroalkane sulfonate such as $LiCF_3SO_3$; perfluoroalkane sulfonylimide salts such as $LiN(CF_3SO_2)_2$, $LiN(CF_3CF_2SO_2)_2$ and $LiN(CF_3SO_2)(C_4F_9SO_2)$; perfluoroalkane sulfonylmethide salts such as $LiC(CF_3SO_2)_3$; and fluoroalkyl fluorinated phosphates such as $Li[PF_5(CF_2CF_2CF_3)]$, $Li[PF_4(CF_2CF_2CF_3)_2]$, $Li[PF_3(CF_2CF_2CF_3)_3]$, $Li[PF_5(CF_2CF_2CF_2CF_3)]$, $Li[PF_4(CF_2CF_2CF_2CF_3)_2]$ and $Li[PF_3(CF_2CF_2CF_2CF_3)_3]$.

Examples of the oxalato borate include lithium bis(oxalato) borate and lithium difluoro(oxalato) borate.

A single kind of lithium salt may be used, or two or more kinds of lithium salt may be used in combination.

From the viewpoint of dissolvability to a solvent, charge/discharge properties or cycle properties of a lithium ion secondary battery, and the like, lithium hexafluorophosphate ($LiPF_6$) is preferred.

The concentration of the electrolyte in the non-aqueous electrolyte is not particularly limited. The concentration of the electrolyte is preferably 0.5 mol/L or more, more preferably 0.6 mol/L or more, further preferably 0.7 mol/L or more. The concentration of the electrolyte is preferably 2 mol/L or less, more preferably 1.8 mol/L or less, further preferably 1.7 mol/L or less.

When the concentration of the electrolyte is 0.5 mol/L or more, the non-aqueous electrolyte tends to have a sufficient degree of electrical conductivity. When the concentration of the electrolyte is 2 mol/L or less, an increase in viscosity of the non-aqueous electrolyte tends to be suppressed, thereby increasing the electrical conductivity. By increasing the electrical conductivity of the non-aqueous electrolyte, performances of a lithium ion secondary battery tend to improve.

(Separator)

The separator is not particularly limited, as long as it exhibits ion permeability while electrically insulating a positive electrode from a negative electrode, and is resistant to the oxidation at a positive-electrode side and the reduction at a negative-electrode side. Materials for a separator that satisfies these properties include resins and inorganic substances.

Examples of the resin include olefin-type polymers, fluorine-type polymers, cellulose-type polymers, polyimide and nylon. It is preferred to select a polymer that is stable with respect to a non-aqueous electrolyte and has a favorable ability to retain a liquid, such as a porous sheet or a nonwoven cloth made of polyolefin such as polyethylene or polypropylene.

Examples of the inorganic substance include oxides such as alumina and silica, nitrides such as aluminum nitride and silicon nitride, and glass. For example, it is possible to use a separator having a configuration in which an inorganic substance is applied onto a film-like substrate in the form of a cloth, a microporous film or the like. Suitable film-like substrates may have a pore size of from 0.01 μm to 11 μm and an average thickness of from 5 μm to 50 μm. It is also possible to use a composite porous layer prepared by bonding an inorganic substance in the form of fibers or particles with a binder such as a resin. The composite porous layer may be formed on a surface of a different separator to form a multilayer separator. Further, the multilayer separator may be formed on a separator of a positive electrode or a negative electrode.

(Other Components)

The lithium ion secondary battery may have a cleavable vent. By opening the cleavable vent, it is possible to suppress a pressure increase caused inside the battery and improve its safety.

The lithium ion secondary battery may have a component for discharging an inert gas such as carbon dioxide when the temperature inside the battery increases. By providing the component for discharging an inert gas, it is possible to open a vent immediately by an inert gas being generated as the temperature inside the battery increases, thereby improving the safety of the battery. The component is preferably formed from a material such as lithium carbonate, polyethylene carbonate or polypropylene carbonate.

In the following, an embodiment of the lithium ion secondary battery having a 18650-type cylindrical shape by referring to a drawing. FIG. 1 is a sectional view of a lithium ion secondary battery according to the present disclosure.

(Exemplary Configuration of Lithium Ion Secondary Battery)

An exemplary configuration of a lithium ion secondary battery is shown in FIG. 1.

The lithium ion secondary battery 1 shown in FIG. 1 has a configuration in which an electrode roll 5 is housed in a cylindrical battery container 6. The electrode roll 5 is formed by rolling a ribbon-shaped positive electrode plate 2 and a ribbon-shaped negative electrode plate 3 with a separator 4 therebetween. On the top of the electrode roll 5, a positive-electrode tab terminal, which has an end being fixed to the positive electrode plate 2, is lead out. The other end of the positive-electrode tab terminal is joined to a bottom side of a battery lid having a disk shape, which is disposed on the top of the electrode roll 5 and functions as a positive-electrode external terminal. At the bottom side of the electrode roll 5, a negative-electrode tab terminal, which has an end being fixed to the negative electrode 3, is lead out. The other end of the negative-electrode tap terminal is joined to an internal bottom of the battery container 6. Accordingly, the positive-electrode tab terminal and the negative-electrode tab terminal are lead out at each of the end faces of the electrode roll 5, respectively. The outer periphery of the electrode roll 5 is covered with an insulating coating (not shown). The battery lid is fixed at the top of the battery container 6 via an insulating gasket made of resin. Therefore, the lithium ion battery secondary 1 is hermetically sealed. The internal space of the lithium ion secondary battery 1 is filled with a non-aqueous electrolyte (not shown).

<Method for Transporting Negative Electrode Material>

The method for transporting a negative electrode material according to the present disclosure is a method for transporting a negative electrode material, the method comprising transporting the packaged negative electrode material as described above.

The method for transportation is not particularly limited, and may be selected from overland transportation, marine transportation, water transportation, air transportation or the like. The means for transporting is not particularly limited, and may be selected from railways, trucks, ships or airplanes.

In the method, a negative electrode material is transported in a state of the packaged negative electrode material as mentioned above. Therefore, degradation of the negative electrode material is effectively suppressed even in a case of transportation in a high-temperature and high-humidity environment. Accordingly, the method is suitable for a case in which a negative electrode material is transported by marine transportation across the equator.

In the method, the amount of time from the dispatch to the arrival is not particularly limited, and may be selected from 1 day to 1 year, for example.

The details and preferred embodiments of the container and the negative electrode material used in the method are the same as the details and preferred embodiments of the container and the negative electrode material as mentioned in the packaged negative electrode material.

<Container for Storing Negative Electrode Material>

The container for storing a negative electrode material according to the present disclosure is a container for storing a negative electrode material, the container having a water vapor transmission rate of 150 g/($m^2$·d)(40° C./90% RH) or less, and the negative electrode material having a micropore volume of $0.40\times10^{-3}$ $m^3$/kg or less.

The container is used for storing a negative electrode material that is a carbon material having a micropore volume of $0.40\times10^{-3}$ $m^3$/kg or less. By using the container, degradation of the negative electrode material is effectively suppressed during storage in a high-temperature and high-humidity environment.

The details and preferred embodiments of the container and the negative electrode material to be stored in the container are the same as the details and preferred embodiments of the container and the negative electrode material as mentioned in the packaged negative electrode material.

The container may be deformable or not deformable. When the purpose of storing a negative electrode material in the container is transportation of the negative electrode material (in particular, long-distance transportation such as import/export), the container is preferably deformable. Examples of the deformable container include a bag-like container such as a flexible container.

<Method for Storing Negative Electrode Material>

The method for storing a negative electrode material according to the present disclosure is a method for storing a negative electrode material, the method comprising storing a negative electrode material in a container, the container having a water vapor transmission rate of 150 g/($m^2$·d)(40° C./90% RH) or less, and the negative electrode material having a micropore volume of $0.40\times10^{-3}$ $m^3$/kg or less.

According to the method, degradation of a negative electrode material having a micropore volume of $0.40\times10^{-3}$ $m^3$/kg or less is effectively suppressed during storage in a high-temperature and high-humidity environment.

The details and preferred embodiments of the container and the negative electrode material used in the method are the same as the details and preferred embodiments of the container and the negative electrode material as mentioned in the packaged negative electrode material.

The container may be deformable or not deformable. When the purpose of containing a negative electrode material in the container is transportation of the negative electrode material (in particular, long-distance transportation such as import/export), the container is preferably deformable. Examples of the deformable container include a bag-like container such as a flexible container.

<Method for Manufacturing Negative Electrode>

The method for manufacturing a negative electrode according to the present disclosure is a method for manufacturing a negative electrode, the method comprising:

extracting the negative electrode material from the container of the packaged negative electrode material as mentioned above; and manufacturing a negative electrode using the negative electrode material extracted from the container.

In the method, extracting the negative electrode material from the container and manufacturing a negative electrode using the negative electrode material extracted from the container may be conducted consecutively.

In a general production method for a negative electrode, a production line is designed such that a negative electrode material is extracted from a container, which is not deformable such as a dram, by way of suction or by inverting a container. Therefore, when a negative electrode material entering the production line is housed in a deformable container, the production method requires a process of transferring the negative electrode material from the deformable container to a container that is not deformable.

By performing a process of extracting a negative electrode material from a container and a process of manufacturing a negative electrode from the negative electrode material extracted from a container consecutively (i.e., without interposing a process of transferring a negative electrode material from the container to a different container), production efficiency is improved.

The method for extracting a negative electrode material from a deformable container is not particularly limited, and examples thereof include hanging a container and opening the bottom of the same; and extracting a negative electrode material from a container using a suction device.

The details and preferred embodiments of the container and the negative electrode material used in the method are the same as the details and preferred embodiments of the container and the negative electrode material as mentioned in the packaged negative electrode material.

In the method, the method for manufacturing a negative electrode material is not particularly limited, and may be selected from known methods.

EXAMPLES

In the following, the embodiments are explained in further detail by referring to the examples. It should be noted that the present disclosure is not limited to the examples.

(1) Preparation of Negative Electrode Material

A mixture was obtained by mixing 100 parts by mass of spherical natural graphite and 10 parts by mass of coal tar pitch (softening point: 90° C., residual carbon rate (carbonization rate): 50%). The mixture was subjected to a thermal treatment, thereby obtaining graphitic particles having a low-crystalline carbon layer on a surface of core particles. The thermal treatment was performed under a nitrogen stream by increasing the temperature from 25° C. to 1000° C. at a rate of 200° C./hour, and retaining the temperature at 1000° C. for 1 hour. The graphitic particles were disintegrated with a cutter mill and classified with a 300-mesh sieve. The undersize fraction of the graphitic particles were referred to as negative electrode material 1.

Graphitic particles were obtained by the same manner as Example 1, except that the temperature for a thermal treatment was changed to 900° C., and referred to as negative electrode material 2.

Graphitic particles were obtained by the same manner as Example 1, except that the temperature for a thermal treatment was changed to 850° C., and referred to as negative electrode material 3.

The negative electrode materials 1-3 had the following micropore volume, volume-average particle size, Ramann R value and BET specific surface area.

<Negative Electrode Material 1>

Micropore volume: $0.18\times10^{-3}$ $m^3$/kg

Volume-average particle size: 10 μm

R value: 0.34

BET specific surface area: 4.5 $m^2$/g

<Negative Electrode Material 2>

Micropore volume: $0.34\times10^{-3}$ $m^3$/kg

Volume-average particle size: 15 μm

R value: 0.40

BET specific surface area: 3.5 $m^2$/g

<Negative Electrode Material 3>

Micropore volume: $0.55\times10^{-3}$ $m^3/kg$

Volume-average particle size: 10 μm

R value: 0.42

BET specific surface area: 4.0 $m^2/g$ (2) Storage Test

Each of the negative electrode materials 1-3 was housed in a container with a volume of 20000 $cm^3$ (height: 80 cm, base area: 250 $cm^2$) made of ultra-high molecular weight polyethylene, and the container was tightly sealed. The container had a water vapor transmission rate of 7.5 $g/(m^2\cdot d)$ (40° C./90% RH). The filling ratio of the negative electrode material in the container was 70%.

The container housing the negative electrode material was subjected to a storage test in which the container was left under the conditions of 80° C. and 90% RH for 2160 hours.

For comparison, the same storage test was conducted on a container housing either negative electrode material 1 or 3 without sealing (i.e., not packaged in a container).

(3) Measurement of Initial Efficiency

A negative electrode plate was prepared by the following process.

Each of the negative electrode materials 1-3 was added with carboxymethyl cellulose (CMC) as a thickening agent and styrene/butadiene rubber (SBR) as a binder at a mass ratio (negative electrode material/CMC/SBR) of 98/1/1. The mixture was added with pure water as a dispersing medium and kneaded, thereby obtaining a slurry for the Examples and Comparative Examples.

The slurry was applied onto each side of a rolled copper foil with an average thickness of 10 μm, as a current collector for a negative electrode, in a substantially uniform manner. The density of the negative electrode composition layer was 1.3 $g/cm^3$.

A negative electrode with a diameter of 14 mm was obtained from the negative electrode plate as mentioned above, and a positive electrode with a diameter of 15 mm was obtained from a metallic lithium plate. A coin-shaped battery was prepared by sandwiching a single-layer polyethylene separator with an average thickness of 30 μm (HIPORE™, Asahi Kasei Corporation) with the negative electrode and the positive electrode.

As a non-aqueous electrolyte, a mixed solvent of ethylene carbonate EC) as a cyclic carbonate, dimethyl carbonate (DMC) as a linear carbonate and ethyl methyl carbonate (EMC) at a ratio (EC/DMC/EMC) of 2/3/2, including 1.2 mol/L of lithium hexafluorophosphate ($LiPF_6$) and 1.0% by mass of vinylene carbonate (VC), was used.

The coin-shaped battery was charged at a constant current of 0.2 CA to 0V (Li/Li+) at 25° C., and further charged at a constant voltage of 0V (Li/Li+) until the current value was 0.01 CA (initial charging). Thereafter, the battery was discharged at a constant current of 0.2CA to 1.5V (initial discharging). A 30-minute interval was interposed between the charging and the discharging.

A value obtained by dividing the amount of initial charging (mAh) by the mass of the negative electrode material (g) was referred to as an initial charged capacity.

A value obtained by dividing the amount of initial discharging (mAh) by the mass of the negative electrode material (g) was referred to as an initial discharged capacity.

An initial efficiency was calculated from the following formula.

Initial efficiency (%)=(initial discharged capacity (mAh/g)/initial charged capacity (mAh/g))×100

(4) Evaluation of Storage Characteristics

A laminate in which a single-layer polyethylene separator with an average thickness of 30 (HIPORE™, Asahi Kasei Corporation) was sandwiched with the negative electrode and the positive electrode was rolled up to obtain an electrode body.

The negative electrode used in the laminate was prepared in the same manner as the negative electrode used for the measurement of initial efficiency. The positive electrode used in the laminate was prepared by a process as described below.

The lengths of the negative electrode, positive electrode and separator were adjusted such that the diameter of the electrode body was 17.15 mm. The electrode body was attached with a collecting lead and inserted in a 18650-type battery case, and a non-aqueous electrolyte was charged in the battery case. Thereafter, the battery case was tightly sealed to obtain a lithium ion secondary battery.

As a non-aqueous electrolyte, a mixed solvent of ethylene carbonate EC) as a cyclic carbonate, dimethyl carbonate (DMC) as a linear carbonate and ethyl methyl carbonate (EMC) at a ratio (EC/DMC/EMC) of 2/3/2, including 1.2 mol/L of lithium hexafluorophosphate ($LiPF_6$) as a lithium salt and 1.0% by mass of vinylene carbonate (VC), was used.

(Preparation of Positive Electrode)

Lamellar lithium/nickel/manganese/cobalt composite oxide (NMC, BET specific surface area: 0.4 $m^2/g$, average particle size (d50): 6.5 μm) was used as a positive-electrode active material. A mixture was obtained by serially adding, to the positive-electrode active material, acetylene black (trade name: HS-100, average particle size: 48 nm (catalog value by Denka Company Limited.), Denka Company Limited.) as a conductive agent and polyvinylidene fluoride as a binder. The mass ratio of the components (positive-electrode active material/conductive agent/binder) was 90/5/5.

The mixture was added with N-methyl-2-pyrollidone (NMP) as a dispersing medium and kneaded, thereby obtaining a slurry-like positive electrode composition. The positive electrode composition was applied in a substantially uniform manner onto each side of an aluminum foil with an average thickness of 20 μm as a current collector for a positive electrode. The positive electrode composition was dried and compressed to have a density of 2.7 $g/cm^3$. The application of the positive electrode composition was performed such that a solid content of the positive electrode composition at each side of the current collector was 40 $g/m^2$.

The lithium ion secondary battery was charged at a constant current of 0.5 CA to 4.2V at 25° C., and then further charged at a constant voltage of 4.2V until the current value was 0.01 CA.

Thereafter, the battery was discharged at a constant current of 0.5CA to 2.7V. Three cycles of the charging and the discharging were performed. A 30-minute interval was interposed between the charging and the discharging.

The lithium ion secondary battery after performing three cycles of the charging and the discharging was referred to as an "initial battery".

The storage characteristic of the initial battery was evaluated by performing the following process.

(1) The initial battery was charged at a constant current of 0.5 CA to 4.2V, and further charged at a constant voltage of 4.2V until the current value was 0.01 CA.

(2) After a 30-minute interval, the battery was discharged at a constant current of 0.5 CA to 2.7V. The discharged capacity A (mAh) at this time was measured.

(3) After a 30-minute interval, the battery was charged at a constant current of 0.5 CA to 4.2V, and further charged at a constant voltage of 4.2V until the current value was 0.01 CA.

(4) The battery was left in an environment of 60° C. for 30 days.

(5) The battery was discharged at a constant current of 0.5 CA to 2.7V. The discharged capacity B (mAh) at this time was measured.

(6) The storage characteristic was calculated from the following formula.

Storage characteristic (%)=(discharged capacity $B$/discharged capacity $A$)×100

TABLE 1

| | Example 1 | Example 2 | Comparative Example 1 | Comparative Example 2 | Comparative Example 3 |
|---|---|---|---|---|---|
| Negative electrode material | 1 | 2 | 3 | 1 | 3 |
| Packaged in container | YES | YES | YES | NO | NO |
| Initial efficiency | 100% | 99% | 95% | 96% | 94% |
| Storage characteristics | 97% | 96% | 89% | 90% | 85% |

As shown in Table 1, Example 1 and Example 2, each housing the negative electrode material 1 or the negative electrode material 2 having a micropore volume of $0.40\times10^{-3}$ $m^3$/kg or less in a container having a water vapor transmission rate of 150 g/($m^2$·d)(40° C./90% RH) or less, exhibit high scores in the initial efficiency and the storage characteristic after the storage test. The results indicate that degradation of a negative electrode material is effectively suppressed during storage in a high-temperature and high-humidity environment.

Comparative Example 1, housing the negative electrode material 3 having a micropore volume of greater than $0.40\times10^{-3}$ $m^3$/kg in a container having a water vapor transmission rate of 150 g/($m^2$·d)(40° C./90% RH) or less, and Comparative Example 2, in which the negative electrode material 1 having a micropore volume of $0.40\times10^{-3}$ $m^3$/kg or less is not packaged in a container, exhibit low scores in the initial efficiency and the storage characteristic after the storage test. The results indicate that degradation of a negative electrode material progressed during storage in a high-temperature and high-humidity environment.

A difference in the initial efficiency and the storage characteristics after the storage test between a case in which the negative electrode material 3 having a micropore volume of greater than $0.40\times10^{-3}$ $m^3$/kg is packaged in a container (Comparative Example 1) and a case in which the negative electrode material 3 is not packaged in a container (Comparative Example 3) is smaller than a difference in the initial efficiency and the storage characteristics after the storage test between a case in which the negative electrode material 1 having a micropore volume of $0.40\times10^{-3}$ $m^3$/kg or less is packaged in a container (Example 1) and a case in which the negative electrode material 1 is not packaged in a container (Comparative Example 2).

The results indicate that the effect of suppressing degradation of a negative electrode material is significant when the negative electrode material has a micropore volume of $0.40\times10^{-3}$ $m^3$/kg or less.

The disclosure of International Patent Application No. 2020/045607 is incorporated herein by reference in its entirety.

All publications, patent applications, and technical standards mentioned in the present specification are incorporated herein by reference to the same extent as if each individual publication, patent application, or technical standard was specifically and individually indicated to be incorporated by reference.

The invention claimed is:

1. A packaged negative electrode material, comprising a container and a negative electrode material contained in the container, the container having a water vapor transmission rate of 150 g/($m^2$·d)(40 C°/90% RH) or less, and the negative electrode material having a micropore volume of $0.40\times10^{-3}$ $m^3$/kg or less.

2. The packaged negative electrode material according to claim 1, wherein the container has a volume of from 6000 $cm^3$ to 40000 $cm^3$.

3. The packaged negative electrode material according to claim 1, wherein a filling ratio of the negative electrode material in the container is from 20% to 90%.

4. The packaged negative electrode material according to claim 1, wherein the negative electrode material is a negative electrode material for a lithium ion secondary battery.

5. The packaged negative electrode material according to claim 1, wherein the container comprises polyethylene.

6. The packaged negative electrode material according to claim 1, wherein the container is deformable.

7. A method for transporting a negative electrode material, the method comprising transporting the packaged negative electrode material according to claim 1.

8. The method for transporting a negative electrode material according to claim 7, wherein a manner of transportation is marine transport.

9. A method for manufacturing a negative electrode, the method comprising:

extracting the negative electrode material from the container of the packaged negative electrode material according to claim 1; and manufacturing a negative electrode using the negative electrode material extracted from the container.

10. The method for manufacturing a negative electrode according to claim 9, wherein the extracting the negative electrode material from the container and the manufacturing a negative electrode using the negative electrode material extracted from the container are conducted consecutively.

11. A method for storing a negative electrode material, the method comprising storing a negative electrode material in a container, the container having a water vapor transmission rate of 150 g/($m^2$·d)(40 C°/90% RH) or less, and the negative electrode material having a micropore volume of $0.40\times10^{-3}$ $m^3$/kg or less.

* * * * *